United States Patent [19]

Arquati

[11] Patent Number: 4,683,935

[45] Date of Patent: Aug. 4, 1987

[54] MOTOR-DRIVEN CURTAIN OPERATING UNIT

[76] Inventor: Ettore Arquati, Via Caduti del Lavoro, 31, 43044 - Collecchio (Parma), Italy

[21] Appl. No.: 817,442

[22] Filed: Jan. 9, 1986

[30] Foreign Application Priority Data

Feb. 20, 1985 [IT] Italy ..... 20847/85[U]

[51] Int. Cl.[4] ..... A47H 5/02

[52] U.S. Cl. ..... 160/331; 160/123; 160/168 R

[58] Field of Search ..... 160/123, 124, 126, 330, 160/331, 340, 345, 346

[56] References Cited

U.S. PATENT DOCUMENTS

| | | | |
|---|---|---|---|
| 1,818,786 | 8/1931 | Bond | 160/346 |
| 2,564,995 | 8/1951 | Rakeman | 160/346 |
| 3,507,317 | 4/1970 | Bratschi | 160/345 |
| 4,227,564 | 10/1980 | Bratschi | 160/126 |
| 4,425,956 | 1/1984 | Terlecke | 160/168 R |
| 4,519,433 | 5/1985 | Corneau | 160/126 |
| 4,552,195 | 11/1985 | Durig | 160/168 R |

FOREIGN PATENT DOCUMENTS

| | | | |
|---|---|---|---|
| 3137769 | 4/1983 | Fed. Rep. of Germany | 160/340 |

*Primary Examiner*—Reinaldo P. Machado
*Assistant Examiner*—Cherney S. Lieberman
*Attorney, Agent, or Firm*—Bucknam and Archer

[57] ABSTRACT

A motor-driven curtain-operating unit for horizontally slidable curtains or the like comprises an elongate support (2) forming a channel (3) having two channel sections (3*a*, 3*b*) laterally separated by a longitudinally extending central wall, each channel section (3*a*, 3*b*) housing a respective run of a closed loop chain (4) one end of which loop passes over a sprocket (5) driveable by a remotely controllable motor (6) and the other end of which passes over a pair of return rollers (20) at the other end of the elongate support (2) from the motor (6). Curtain displacement carriages (10), attachable to a movable edge of a curtain, are slidable in the channels (3*a*, 3*b*), and each incorporates a sleeve portion (11) through which the chain (4) can pass to form a connection between the chain (4) and the carriage (10). A resiliently biased pin (13) projects into the sleeve (11) and forms an interconnection between the carriage (10) and the chain (4) which can be overcome to allow relative slip between the carriage (10) and the chain (4) if the force between them exceeds a certain threshold value such as if there is an obstruction to curtain movement or if the curtain has reached the end of its movement and the motor (6) is still energized.

1 Claim, 6 Drawing Figures

MOTOR-DRIVEN CURTAIN OPERATING UNIT

The present invention relates to a motorised curtain operating unit, and that is to say a support track for curtains and the like having a motor and pulley system for drawing curtains suspended therefrom, between a closed and an open position.

There are currently available on the market motorised units for automatically effecting the opening and closure movement of horizontally sliding suspended curtains. Such units generally employ a motor which, by means of cords or similar elements, is connected to drive small carriages which slide or roll on the track and which are themselves connected to those edges of the curtains which are displaced upon opening or closure movement thereof.

Various disadvantages are encountered with the known type of curtain operating units, particularly when the user does not switch off the motor in good time, when the curtain has reached the end of either its opening or its closing movement. Another disadvantage, encountered with the prior art units is constituted by the fact that they require rather complex mountings and usually have large dimensions and are particularly bulky where the motor is housed. For these reasons they have not been well received by the public, especially for domestic situations where the fact that the motor is visible is aesthetically unacceptable.

The present invention seeks to overcome the above indicated disadvantages of the prior art by providing a new motor-driven curtain-operating unit which allows a motor of very reduced dimensions to be used in such a way that it is easily concealed by the curtain itself, and which avoids the risk of damage or jamming of the curtains-operating unit even in a case in which the user continues to actuate the motor after the curtain has reached the end of its opening or closure movement.

According to the present invention, there is provided a motor-driven curtain-operating unit characterised by the fact that it includes a support bar which defines a guide track for a closed loop chain extending at one end of the loop over a driving sprocket driven by a motor which can be remotely controlled, and, at the other end over return rollers, the said chain being connected to at least one carriage slidable along along the said guide track and connectable to an edge of a curtain, the connection of the chain to the carriage being such as to permit relative slipping movement between the two to take place when a force greater than a certain threshold value is applied between them.

One advantage of a curtain-operating unit formed in accordance with the principles of the present invention lies in the fact that it allows a considerable simplification of both the assembly and the installation operations, and, moreover, it offers the widest guarantee of reliability and security in use. Another advantage of a curtain-operating unit formed as an embodiment of the present invention is that it provides a motor-driven unit which can be easily obtained utilising elements and materials which are commonly commercially available. Embodiments of the present invention are also advantageous from an economic point of view in that they can be produced at less cost than has hithertofore been practicable.

One embodiment of the present invention will now be more particularly described, by way of example with reference to the accompanying drawings, in which.

Figure 2:
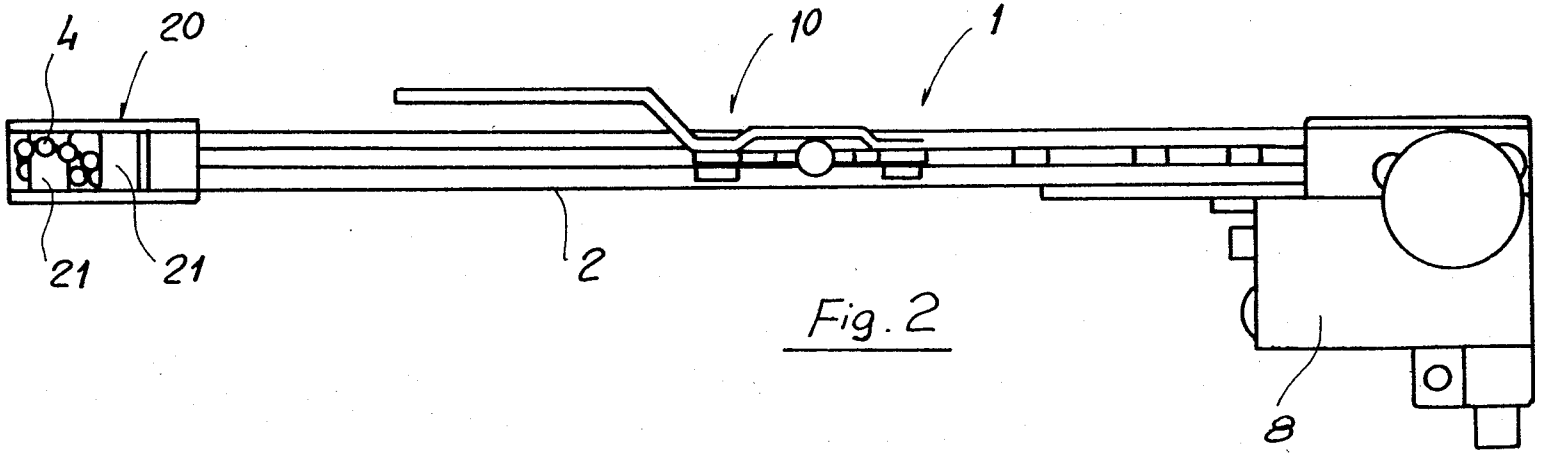
FIG. 2 is a plan view from below of the unit illustrated in FIG. 1.
Figure 1:
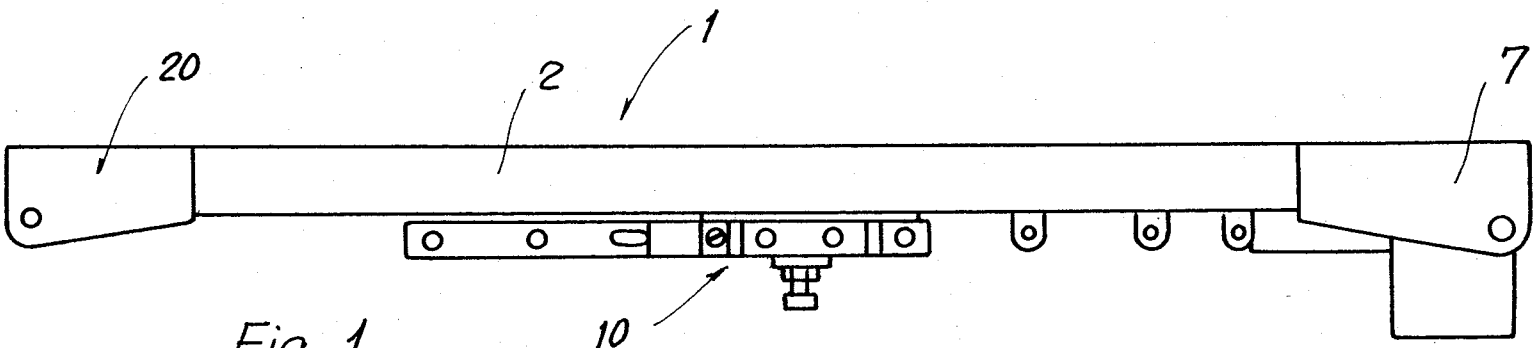
FIG. 1 is a schematic front view of a motor-driven curtain-operating unit formed as an embodiment of the invention.
Figure 3:
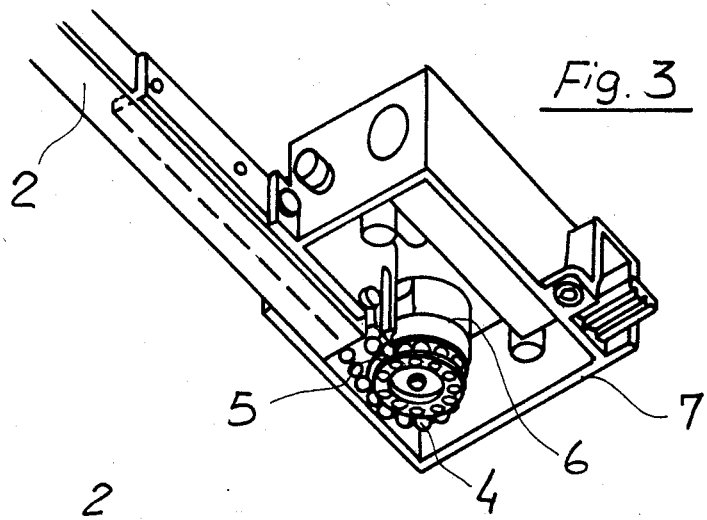
FIG. 3 is a perspective view of the motor positioned at the end of the curtain support track.
Figure 4:
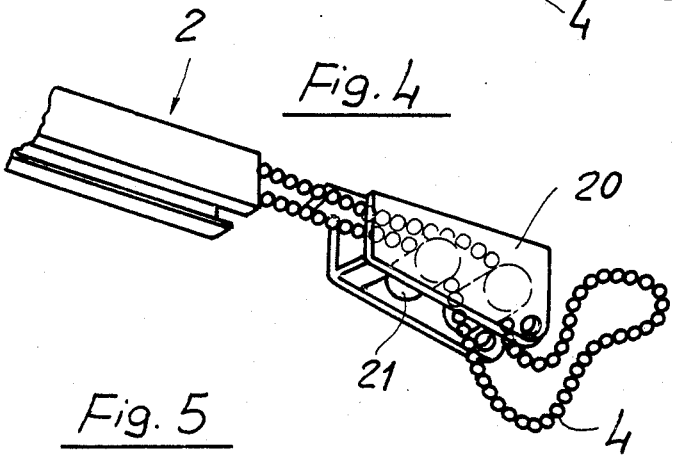
FIG. 4 is a schematic exploded perspective view of the return rollers positioned at the outer end of the curtain support track from the motor shown in FIG. 3.
Figure 5:
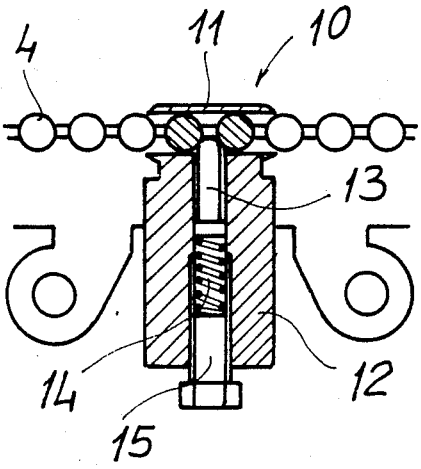
FIG. 5 is a sectional view of a carriage for connection to a displaceable edge of a curtain.
Figure 6:
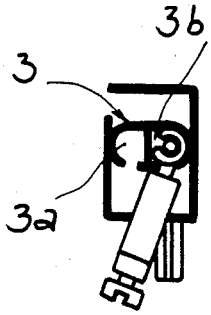
FIG. 6 is a sectional view showing an intermediate stage in the mounting of the carriage shown in FIG. 5.

Referring now to the drawings, the motor-driven curtain track unit shown therein is generally indicated with the reference numeral 1, and comprises a support bar 2 which constitutes a sliding track in the form of a sliding channel 3 for a chain 4 which, in this embodiment is a chain of small balls. The channel 3 is separated by a dividing wall into two separate channel parts indicated 3*a* and 3*b*. These latter are separated from one another longitudinally such as to define in practice the two routes along which two runs of the ball chain 4 are displaced.

At one end of the track 2 the ball chain 4 passes over a sprocket 5 which is rotatable by a motor 6 lodged within a box-like casing 7, which is connectable directly to the end of the sliding track 2. The motor 6 is advantageously remote controlled by means of an infra red signal, thus rendering the action of opening and closing the curtains very practical and easy. The box-like casing 7, which is advantageously housed at the right hand end of the curtain, is closable from below by a cover 8 (see FIG. 2) which closes the interior zone thus concealing the interior working mechanism from view.

A curtain-drawing carriage, generally indicated with the reference numeral 10, is connected to the chain 4, and is slidable along the track 2. The upper part of the curtain-drawing carriage 10 is formed as a horizontal sleeve portion 11 through which the chain 4 can pass. The sleeve portion 11 is slidably received in one of the channel zones 3*a* or 3*b* of the sliding channel 3 along which the chain 4 also slides.

The carriage 10 is connected to the chain 4 by a linear slipping clutch arrangement in the form of friction sliding means, which will be disclosed in a more detailed way thereinafter, allowing relative displacement of the carriage 10 with respect to the chain 4, in such a way that if, when the carriage has reached the end of its movement (either closing or opening the curtains) the motor continues to be actuated, then no unwanted forces on the motor itself are created in that relative slipping movement between the carriage 10 and the chain 4 can take place.

To obtain such relative slipping movement the body 12 of the carriage 10 is formed with a bore in which is housed a slidable pin 13 which is resiliently thrust by biasing means to insert itself between one link of the chain 4 and the next. The resilient biasing means comprises a compression spring 14 acting on the pin 13 at one end, whilst at its other end the spring 14 is in contact with an adjustment screw 15 which allows the pre-loading on the spring itself to be adjusted at will, thus consequently allowing variation in the resilient thrust action which urges the pin 13 between two contiguous balls of the chain 4. This feature is a very important one, since it affords the possibility of easily fitting the inventive unit to different weight curtains.

The end of the pin 13 which is introduced between the links of the chain 4 is suitably rounded in such a way that, when the carriage 10 reaches the end of its movement, either opening or closing of the curtains, if the energisation of the motor 6 is maintained, the chain 4 is able to slip with respect to the carriage 10 in that the balls held by the resilient thrust exerted by the spring 14 now cause the retraction of the pin 13 into the bore in the body 12, without causing any damage to the motor. More specifically, with the pin retracted into the bore of the body 12, the chain will slip with respect to the carriage, since the carriage will disengage from the chain itself, because of the mentioned retraction of said pin. In this connection it should be pointed out that the engagement between the carriage and the ball chain, which is maintained by the pin 13 during the opening and closing movements of the carriage, and which is released at the carriage end of stroke positions, is very different from a simple friction engagement of a curtain hanger retained on a cord, since the pin 13 head inserts between two balls of the chain, thereby increasing the friction force. In this way also comparatively high weight curtains can be properly operated.

It is appropriate to state, for completeness of the description, that at the end of the bar 2 opposite that connected to the motor 6 there is fitted a terminal housing 20 in which are rotatably carried two return wheels 21 over which the loop of the chain 4 passes to effect continuous circulation thereof.

It is to be emphasized that the invention provides a motor-driven curtain-operating unit of very reduced dimensions, the motor 6 of which is easily remote controlled. Moreover, the use of a carriage 10 which is provided with friction slipping means gives the significant possibility of avoiding the possibility of damage to the motor, which would occur in the prior art units if the motor were to continue to be energised with the carriage 10 in an end of path position. Such a protection, in particular, does not require the use of expensive limit switches, but the simple provision of a ball chain in combination with the disclosed friction clutch means for engaging the curtain supporting carriage on the chain.

Another important aspect of the invention is constituted by the fact that the fitting of the motor-driven unit is extremely simple in that its casing 7 can easily be fitted to the end of a support bar 2 constituting a sliding track.

In practice, as long as they are compatible with the specific use, any materials can be used and, likewise, any dimensions and contingent forms can be employed according to requirements.

I claim:

1. A motor-driven curtain-operating unit comprising an elongate supporting two-channel guide track for a closed loop ball chain extending at one end of the loop over a driving sprocket driven by a remotely controlled motor and at the other over return rollers, a carriage slidable along said track, said chain being connected to said carriage slidable along said guide track and connectable to an edge of a curtain, said carriage having a body defining an upper sleeve portion through which said chain passes, said sleeve portion being slidable in one of the channels of said guide track and the body of said carriage having a bore therein housing a rounded-head pin urged by a spring to project from said bore such that its end is located between two adjacent balls of said chain whereby, if the motor is actuated with said carriage in an end of stroke position with the curtains open or closed, said balls of said chain cause resilient retraction of said pin into said bore of said body to achieve a relative slipping movement between said carriage and said chain, said motor-driven curtain-operating unit further comprising an adjustment screw housed in said bore of said body for calibrating the resilient thrust of said spring acting on said pin.

* * * * *